United States Patent [19]

Meyer et al.

[11] 4,032,295

[45] June 28, 1977

[54] TOY VEHICLE FOR USE WITH A FIGURE TOY

[75] Inventors: Burton C. Meyer, Downers Grove; Robert K. Allen, Hinsdale, both of Ill.

[73] Assignee: Marvin Glass & Associates, Chicago, Ill.

[22] Filed: Feb. 19, 1976

[21] Appl. No.: 659,366

[52] U.S. Cl. ..... 46/202; 46/221; 46/248

[51] Int. Cl.[2] ..... A63H 17/12

[58] Field of Search ..... 46/2, 201, 202, 221, 46/248, 251; 296/23 R

[56] References Cited

UNITED STATES PATENTS

| | | | |
|---|---|---|---|
| 3,071,895 | 1/1963 | Gelfand et al. | 46/248 |
| 3,300,894 | 1/1967 | Glass et al. | 46/202 |
| 3,475,048 | 10/1969 | McNamee | 296/23 R |
| 3,653,147 | 4/1972 | Zbikowski | 46/202 |

*Primary Examiner*—Russell R. Kinsey
*Assistant Examiner*—Robert F. Cutting
*Attorney, Agent, or Firm*—Mason, Kolehmainen, Rathburn & Wyss

[57] ABSTRACT

A wheeled, toy vehicle or van which includes a plurality of operable devices or accessories. The toy vehicle is adapted for use with a figure toy having a pair of mechanical hands in the form of hooks. The van includes a front end which opens to provide access to the cab or driving compartment and a rear tailgate which opens to provide access to the back, cargo area of the van. A ladder is adapted to be hooked onto the side of the van to permit climbing onto the top or roof of the van by the hooks of the figure toy for use of the various accessories. One of the accessories includes a large, mechanical hand which mounts to the interior, exposed surface of the tailgate when the tailgate is in an open, fully vertical position. A side door on the van provides access to the rear portion thereof, which includes a periscope and a radar-computer control console for use by the figure toy. Many of the accessories include especially adapted handles for use by the mechanical hand hooks of the figure toy.

21 Claims, 11 Drawing Figures

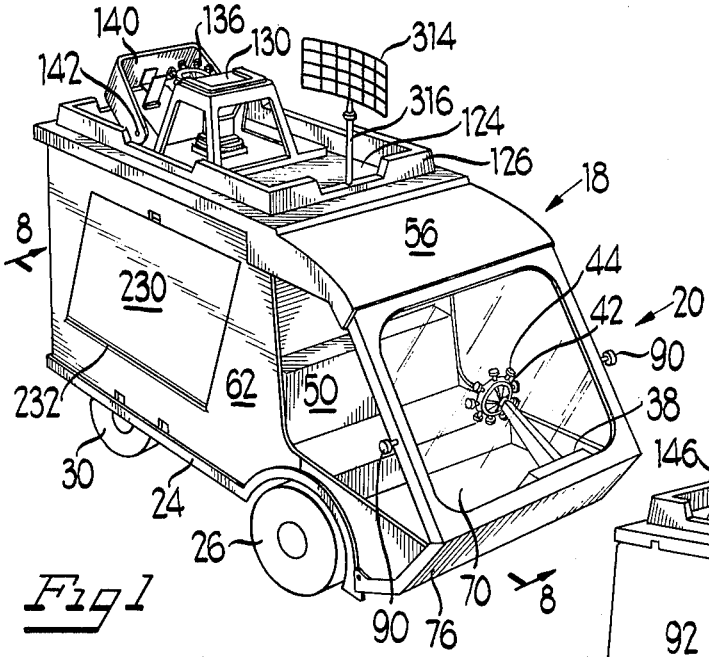
Fig 1
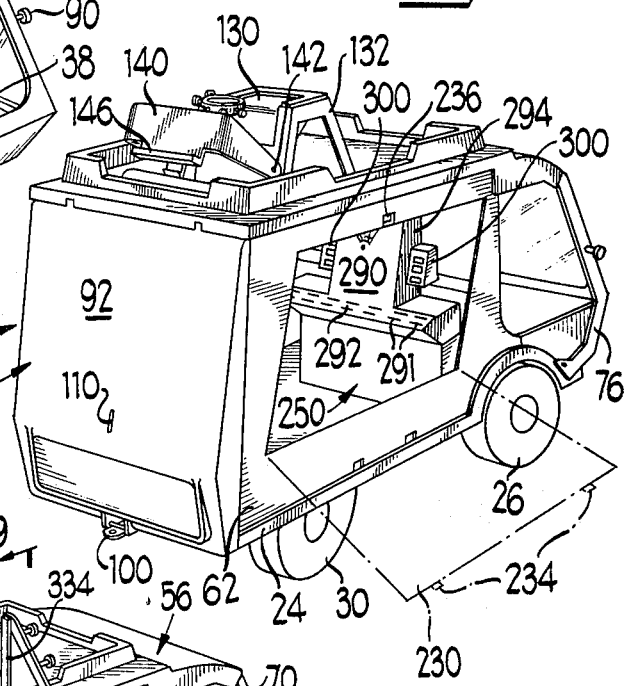
Fig 2
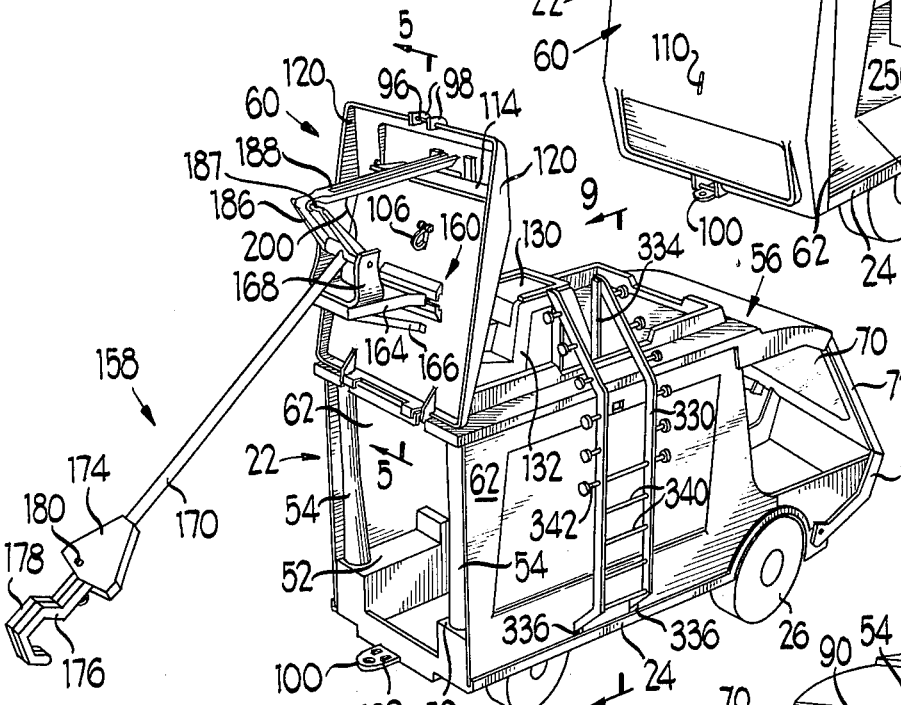
Fig 3
Fig 4

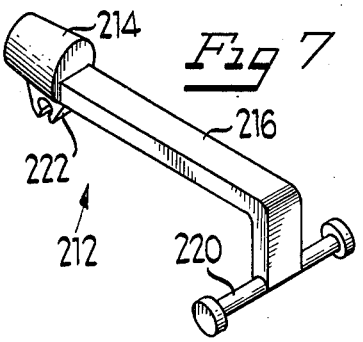
Fig 7
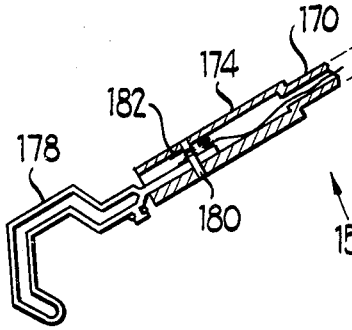
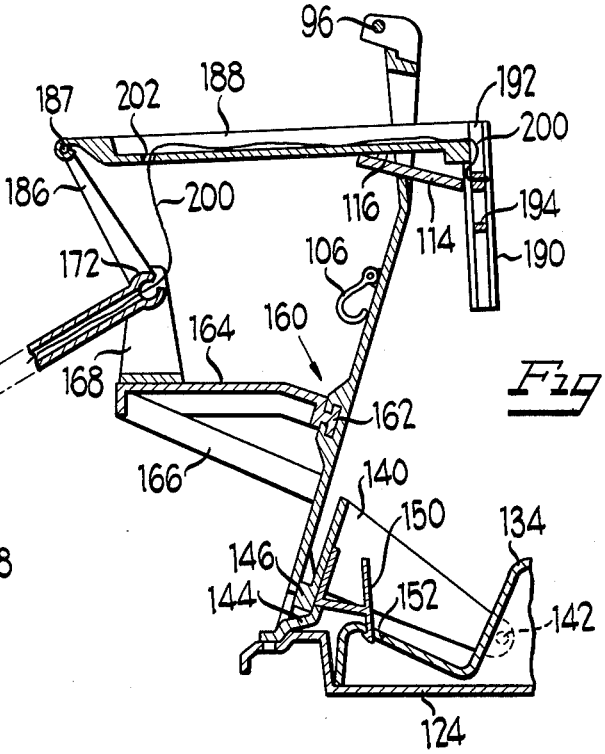
Fig 5
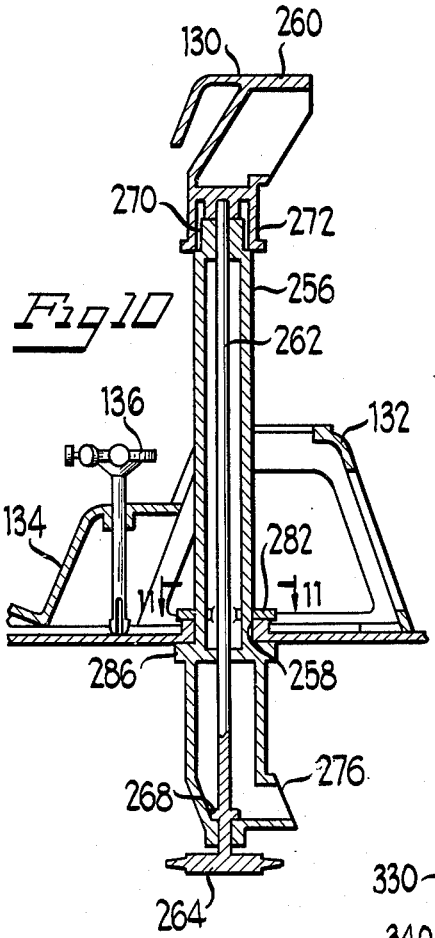
Fig 10
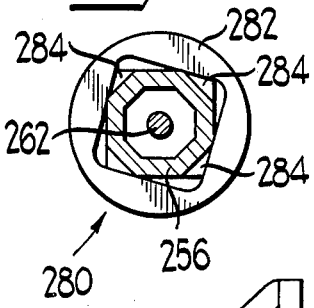
Fig 11
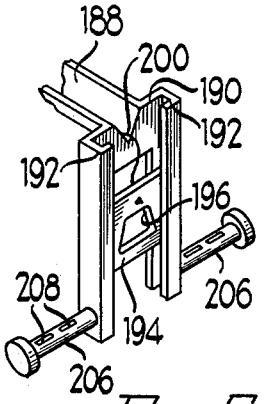
Fig 6
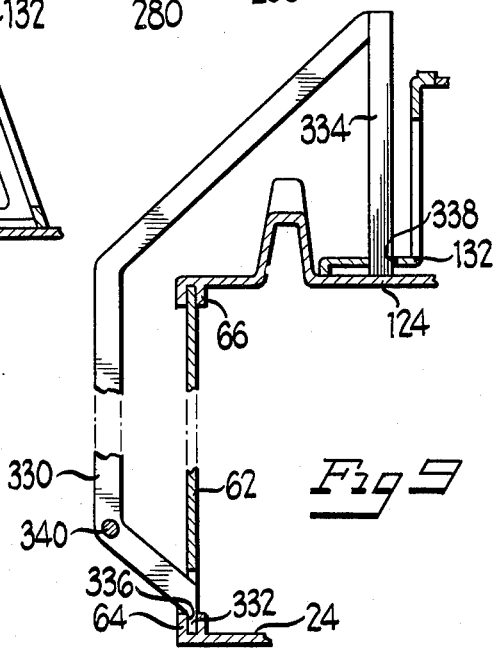
Fig 9

82
84
86
38
76
78
40
42
20
A
72
70
74
44
46
80
36
26
28
50
314
316
296
320
318
54
310
308
322
300
304
306
309
302
250
290
298
291
292
56
124
126
132
128
260
130
270
272
282
252
286
242
244
246
24
240
276
268
264
136
134
258
256
262
22
52
32
30
140
150
152
C
146
120
54
90
144
60
154
92
108
110
106
116
B
96
98
102
94

TOY VEHICLE FOR USE WITH A FIGURE TOY

BACKGROUND OF THE INVENTION

1. Field of the Invention

This invention is a copending application of U.S. patent application Ser. No. 659,230 filed Feb. 18, 1976, and assigned to the assignee of the present invention. This invention relates to a toy vehicle or van particularly adapted for use by the figure toy disclosed in the above-captioned copending application, which figure toy has mechanical hands in the form of hooks.

2. Brief Description of the Prior Art

Many toy vehicles have been provided which include a various number of accessories designed to be used by figure toys of appropriate size. Such vehicles and toy combinations have included vehicles for toy soldiers, mobile homes or vans, toy campers and the like.

An object of the present invention is to provide a vehicle for use with a figure toy having a pair of mechanical hands in the form of hooks.

SUMMARY OF THE INVENTION

In accordance with the above and other objects, a toy truck is contemplated which includes a plurality of accessories or operable devices designed and adapted to be used, in particular, by a figure toy having a pair of mechanical hands or hooks.

The toy vehicle, itself, is adapted for driving by a figure toy having a pair of mechanical hands or hooks. The vehicle includes a front door construction which opens to provide access to the cab or driving compartment and a rear tailgate which opens to provide access to the back of the van. A ladder is adapted to be hooked onto the side of the van to permit climbing onto the top or roof of the van by the figure toy for use of various accessories. One of the accessories includes a large, mechanical hand which mounts to the interior, exposed surface of the tailgate, when the tailgate is in an open fully vertical position. A side door on the van provides access to the rear portion which includes a periscope and a radar simulated computer control console for use by the figure toy.

Many of the accessories include especially adapted handles for use by a figure toy having a pair of mechanical hands or hooks.

Other objects, features and advantages of the invention will be apparent from the following detailed description taken in connection with the accompanying drawings.

BRIEF DESCRIPTION OF THE DRAWINGS

FIG. 1 is a front perspective view of a toy vehicle made in accordance with the concepts of the present invention;

FIG. 2 is a rear perspective view of the toy vehicle of FIG. 1 showing the side door in an open position;

FIG. 4 is a front perspective view of the toy vehicle showing the front compartment of the vehicle in an open position;

FIG. 5 is a vertical section, on an enlarged scale, taken generally along line 5—5 of FIG. 3;

FIG. 6 is a perspective view of the manually operable handle of the device shown in FIG. 5;

FIG. 7 is a perspective view, on an enlarged scale, of a mounting device for use with a grappling hook and launcher;

FIG. 8 is a vertical section, on an enlarged scale, of the toy vehicle taken generally along line 8—8 of FIG. 1;

FIG. 9 is a fragmented, vertical section, on an enlarged scale, taken generally along line 9—9 of FIG. 3;

FIG. 10 is a fragmented, vertical section, similar to FIG. 8, showing a periscope device in an extended position; and FIG. 11 is a vertical section, on an enlarged scale, of the periscope locking device taken generally along line 11—11 of FIG. 10.

DESCRIPTION OF THE PREFERRED EMBODIMENT

Figure 3:
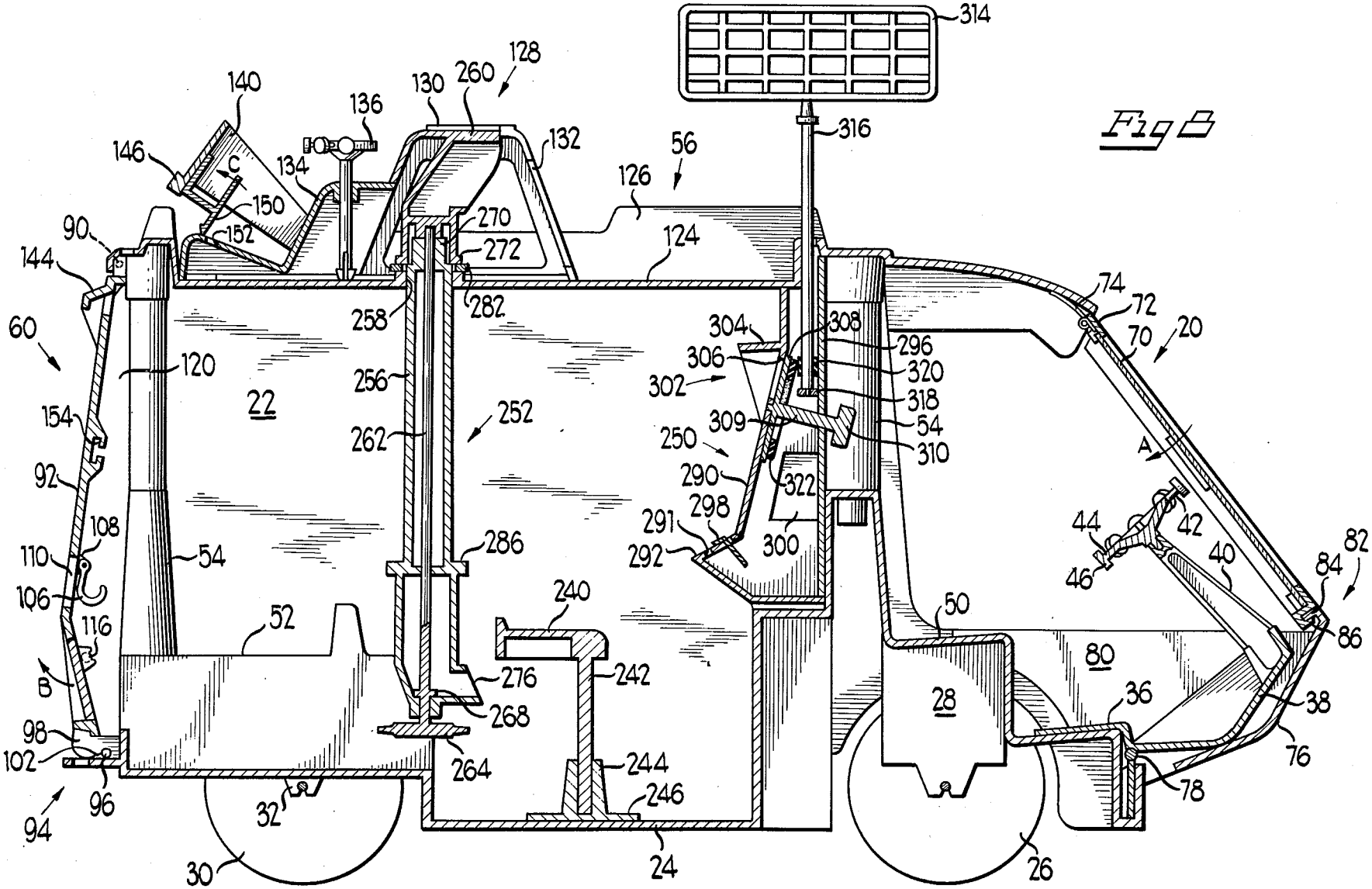
FIG. 3 is a rear perspective view, similar to FIG. 2, showing the tailgate in a fully opened position with a ladder mounted on the side thereof.

A toy vehicle made in accordance with the teachings of this invention is shown in several perspective views (FIGS. 1 through 4). The toy vehicle, generally designated 18, is in the shape of a truck or van having a front cab portion 20 and a rear compartment, generally designated 22, for storing cargo or the like. The van 18 of the present invention includes particular adaptations, some of which are designed particularly for use by a figure toy having a pair of mechanical hands in the form of hooks such as shown in copending U.S. patent application Ser. No. 659,230 filed Feb. 18, 1976, assigned to the assignee of the present invention. The aforementioned application is incorporated by reference herein and made a part hereof.

The toy vehicle 18 includes a generally rectangular frame or chassis 24 extending from front to rear. A pair of front wheels 26 are rotatably mounted by a pair of depending flanges 28 and a pair of rear wheels 30 are mounted by a similar pair of flanges 32 at the rear of the chassis 24.

Referring to FIG. 8, the front compartment or cab 20 includes a subfloor 36 having a footrest or pan 38 for the figure toy driver. The footrest supports a steering column 40 and a steering wheel 42. The steering wheel includes a plurality of radially directed handles 44 each of which terminates in an enlarged disc 46 to facilitate steering of the vehicle by the figure toy which has mechanical hands. A front seat 50 within the cab 20 is molded integrally with the chassis 24. Referring to FIG. 3 and to the left of FIG. 8, the rear of the chassis includes a pair of longitudinal seats 52. The front seat 50 and the rear seat 52 each support two posts or pillars 54 which support and connect the top or roof of the van, generally designated 56, to the chassis 24.

A tailgate, generally designated 60 (FIGS. 2, 3 and 8), is pivotally mounted to the top of the vehicle providing access to the cargo area 22 thereof. Two side panels 62 are mounted to the chassis by a channel 64 (FIG. 9) on either side of the bottom of the chassis and a complementary channel 66 on the top 56. Since the top 56 is supported on the chassis by the vertical posts 54 the side panels 62 can be easily slidably removed and replaced.

Referring to FIGS. 4 and 8, a front entrance is provided for the cab 20 so that the user may "scoop up" an adversary for capture or to facilitate a quick get-away if desired. The cab includes a front windshield 70 which is pivotally mounted by a rectangular frame 72 to the top 56. A spring biasing means 74 (FIG. 8 ) constantly biases the windshield 70 toward an open position as shown in FIG. 4. A lower front portion 76 is pivotally mounted by pins 78 (FIG. 8) for movement between a closed position as shown in FIG. 8 and an open position as shown in FIG. 4. The front portion 76 includes a pair of rearwardly directed side walls or flanges 80 which simulate the side doors of the cab 20. When the front portion 76 is pivoted downwardly as shown in FIG. 4, the windshield 70 will pivot upwardly, thus providing a large area for entrance to the cab. Connecting means, generally designated 82 (FIG. 8), are provided to maintain the windshield 70 and front portion 76 in a closed position. The connecting means 82 includes a rearwardly and downwardly directed transverse flange 84 which mates with a complementary forward and upwardly directed flange 86 on the windshield frame 72. When in its closed position, as shown in FIG. 8, the biasing force of the spring 74 on the windshield and frame 70 and 72 maintains the connecting means 82 in engagement. A pair of handles, generally designated 90, similar to the handles 44 on the steering wheel, are mounted on opposite sides of the windshield frame 72 for grasping by a figure toy having a pair of mechanical hands. A slight rearward force, in the direction of arrow A in FIG. 8, against the force of the biasing spring 74 will cause the connecting means 82 to be released thereby permitting the front portion 76 to drop due to gravity to the position as shown in FIG. 1. Subsequent release of the windshield frame will permit the windshield to pivot upwardly, as shown in FIG. 4.

The tailgate 60 is connected to the rearwardmost edge of the top 56 by a detachable hinge 90 for pivotal movement between a fully closed position as shown in FIG. 2 to a fully open position as shown in FIG. 3. The tailgate includes a generally rectangular panel 92 which is maintained in a closed position (FIGS. 2 and 8) by detent means 94.

The detent means 94 includes a cross bar 96 supported on the bottommost edge of the panel 92 by a pair of flanges 98. A trailer hitch 100 extends rearwardly from the bottom of the chassis 24 and includes a pair of raised triangular ribs 102 which act as a catch, engaging the cross bar 96 to maintain the tailgate 60 in a closed position. The exterior surface of the tailgate 60 is generally flat or smooth and includes no handle to facilitate manual opening. However, a metallic hook 106 is pivotally mounted by a flange 108 to the interior of the door in generally vertical alignment with a slot 110 therebehind. The metallic hook 106 is made of a ferrous metal so that it can be attracted by a magnet and drawn through the slot 110 to facilitate grasping. As described in the previous incorporated patent application, the figure toy includes a "magnetic hand" which can be used to attract the hood 106 through the door. The figure toy then can use one of the mechanical hands to grasp the hook and open the tailgate to provide access to the cargo area 22. The hook 106 and slot 110 provide a security device which cannot be opened without the proper implements.

The panel 92 includes a pivotally mounted insert panel 114 at its lowermost end, as shown in FIGS. 2 and 8. The panel 114 is pivoted by a shaft 116 connected to a pair of peripheral flanges 120 on either side of the main panel 92. The panel 114 is designed to pivot generally outwardly as shown by arrow B in FIG. 8 and includes a simulated instrument panel on the interior side thereof. When the tailgate 60 is fully opened to its position as shown in FIG. 3, the instrument panel 114 is viewable by a figure toy on the top 56 of the van.

When the tailgate 60 is in its generally vertically oriented open position (FIG. 3), the tailgate itself acts as a control panel for various functions to be operated by a figure toy on the top of the van. More particularly, referring to FIGS. 1, 2, 3 and 8, the top 56 of the van includes a standing surface 124 for a figure toy which is generally surrounded by a peripheral safety flange 126. A seat, generally designated 128, is provided approximately in the middle of the surface 124 for seating a figure toy. The seat 128 includes a sitting surface 130 mounted by a seat frame 132 above the surface which faces a generally rearward direction. The seat frame 132 includes a rearwardly continuous portion 134 which rotatably supports a second steering wheel 136 for driving the vehicle 18. A second footrest or pan 140 is mounted rearwardly of the second steering wheel 136 for the feet of the figure toy. The pan 140 is pivotally mounted by a pair of pins 142 and serves to lock the tailgate 60 in its up position.

More particularly, referring to FIGS. 8 and 5, the outside upper edge of the tailgate 60 includes a flange 144 which is directed generally upwardly when the tailgate is in its open position. A locking notch 146 on the rearward exposed end of the pan 140 seats behind the flange 144 to lock the tailgate as shown in FIG. 3. The pan 140 is pivoted downwardly while a locking tab 150 is simultaneously actuated by a manual force in the direction of arrow C. The locking tab 150 seats within an aperture 152 as shown in FIG. 5 to thereby lock the notch 146 within the flange 144 to securely maintain the tailgate in its upward position.

The interior of the tailgate 60 includes means defining a T-slot 154 directed rearwardly and outwardly when the tailgate is in its up position. A mechanical grasping device, generally designated 158 (FIGS. 3 and 5), may be attached to the T-slot 154 by a suitable connecting means, generally designated 160 (FIG. 5). The connecting means includes a T-connector 162 on the end of a cantilever arm 164 which extends rearwardly with additional buttressing ribs 166 engaging the tailgate below the slot 154. A yoke 168 (FIGS. 3 and 5) is secured to the end of the cantilever arm 164 for pivotally mounting the grasping device 158.

More particularly, the grasping device includes a hollow, elongated arm 170 which is pivotally mounted by an axle 172 within the yoke 168. The arm 170 terminates in a triangular housing 174 which comprises a portion of the grasping device. A stationary hook 176 is secured to the housing 174 and a movable complementary grasping hook 178 is pivotally mounted by a pin 180 generally alongside the stationary hook 176. A small biasing means or spring 182 constantly urges the movable hook 178 into engagement with the stationary hook 176. A control yoke, generally designated 186, is preferably molded integrally with the axle 172 generally at a right angle with respect to the arm 170 to extend generally upwardly as shown in FIGS. 3 and 5. A generally horizontal longitudinal control arm 188 is pivotally connected to a shaft 187 spanning the open ends of the control yoke 186 and extends above the instrument panel 114 to the forward side of the tailgate 60 in the area adjacent the seated figure toy. The longitudinal arm 188 is generally V-shaped in cross-section as shown in the perspective view of FIG. 6 and terminates in a generally vertical slide or channel 190 having a pair of L-shaped flanges 192 defining the vertical channel. A sliding member 194 is positioned within the channel 190 and includes an aperture 196 therein for grasping by the user. Preferably the aperture 196 is adapted to be engaged by the hooks or mechanical hands of the figure toy described in the above-mentioned application. A control line or wire 200 is connected to the slide 194 at one end, passed through the V-shaped arm 188, through an aperture 202 (FIG. 5) and down the elongated arm 170 to the housing 174. The line 200 is connected to the movable hook 178 at a point off-center from its pivot point 180 so that a force on the control line 200 will cause the grasping device to open against the force of the biasing spring 182. Therefore, by simply moving the slide 194, the figure toy can be made to operate the remote grasping device 158 while longitudinal movement of the horizontal arm 188 will cause the grasping device to pivot about the axle 172 to any desired altitude. At least one handle 206 is provided on the channel 190 for grasping by the figure toy. The handle 206 is similar to the handles 44 but includes a pair of vertical apertures 208 in a side-by-side relationship, as shown in FIG. 6, for engagement by the mechanical hands of the previously described figure toy.

In the above referred to patent application which has been incorporated herein, a grappling hook and launcher was described for use with the figure toy therein. The launcher included a connecting means for securing the launcher to the end of the figure toy's arm. In the present invention, a grappling hook launcher mounting device, generally designated 212 (FIG. 7), is provided to rigidly mount the launcher on the vehicle 18. More particularly, the launcher mounter 212 includes a frustoconical connecting end 214 having the appropriate connector for mounting the launcher. The frusto-conical end 214 is connected by a fabricated arm 216 to a pair of handles 220 similar to the handles 206 described above. A flexible clamp 222 is mounted to the fabricated arm 216 on the bottom thereof and mounts directly to the cross bar 96 on the top of the tailgate 60 when in the open position. The launcher mounter will support the grappling hook launcher for operation by the figure toy when in position on the top of the van.

Referring to FIG. 2, one side panel 62 is provided with a door 230 for access to the cargo area from the side of the van. The door 230 is pivoted by a flexible hinge 232 such as a crimp in a sheet of vinyl material. The top of the door includes a pair of tabs 234 (FIG. 2) which flex and seat behind the interior side of the side panel 62 to support the door in a closed position. Since the door will be flush with the side panel 62, a notch 236 is provided at the center of the door opening through which the figure toy may insert his "mechanical hands" or hooks in order to open the door. This is another security device, similar to the hook in the tailgate 60 which prevents sabotage or unauthorized access to the interior of the van.

Referring to FIG. 8, a rotatable seat 240 is mounted by a shaft 242 for the figure toy. The shaft 242 is slip fit within a tapered base 244 secured to the bottom of the chassis 24 by a generally circular flange 246. The seat 240, as shown in FIG. 8, is directed generally toward the front of the truck toward a computer control panel, generally designated 250. The seat 240 can be rotated 180 degrees to permit use of a periscope, generally designated 252. The periscope 252 includes an elongated square cross-sectional shaft 256 slidably mounted within a complementary aperture 258 in the top support surface 124 of the vehicle. A rotatable "lens portion" 260 comprising a subportion of the seat assembly is rotatably mounted on the top of the shaft 256 and connected by an internal rotatable shaft 262 to a handwheel 264 mounted on the bottom of the shaft 256. An enlarged circular flange 268 provides a vertical bearing surface for the shaft 262 while a reduced, top closed end 270 of the square shaft 256 provides a shoulder for a depending circular collar 272 on the periscope "lens" 260. A sighting aperture, screen, or opening 276 at the base of the elongated shaft 256 permits viewing into the periscope 252. The periscope is movable, vertically, between a down, hidden position as shown in FIG. 8 and an up, extended position for use as shown in FIG. 10. A locking device, generally designated 280 (FIG. 11), is provided on the shaft 256 to maintain the periscope in its up position. The locking device includes a flange 282 mounted on the top of the surface 124 in alignment with the aperture 258 as seen in FIGS. 10 and 11. The elongated square cross-sectional shaft 256 includes four cutouts or notches 284 which, when the periscope shaft 256 is rotated, permit interengagement with the disc 282 to support the periscope 252 in its extended position. A shoulder 286 below the notches 284 abuts the underside of the surface 124 when the periscope is in a fully extended position as shown in FIG. 10. Thus, the periscope 252 can be raised and lowered at will and, when in its raised position can be rotated to "scan" the surroundings by rotation of the handwheel 264.

The seat 240 as described above may be rotated to position a figure toy thereon in a forwardly facing direction in front of the "computer control panel" 250. The control panel 250 includes a generally vertical surface 290 and a generally canted surface 292. The canted surface 292 includes a plurality of slots 291 indicative of insertion slots for programming a computer. The generally vertical surface 290 is narrower than the control surface portion and has a side wall 294 on either side thereof (FIG. 2). A rear wall 296 for the control panel defines a partition between the cab and the cargo area of the van 18. A plurality of computer programming cards 298 are provided for insertion into the slots 291 and may be stored on either side of the control panel in appropriate storage boxes 300.

The center of the control panel mounts a "radar scope", generally designated 302 which is appropriately shielded by a hood 304. The radar scope 302 includes a generally pie-shaped aperture 306 in the front wall 290 behind which is mounted a rotatable disc 308 carrying indicia thereon representative of a radar screen picture. The disc 308 is mounted by a shaft 309 rotatably mounted in the control panel surface 290 and the dividing wall 296. A manually rotatable knob 310 on the cab side of the dividing wall 294 can be rotated to cause the radar scope image to change.

A radar antennae 314 is rotatably mounted at an elevated position above the top of the van by a shaft 316 vertically supported by a rearwardly directed rib 318 secured to the dividing wall 296. A rubber collar or drive surface 320 on the rotatable shaft 316 engages a similar rubber ring 322 on the back of the disc 308, so that as the disc is manually rotated by the knob 310, the radar screen will rotate. Thus, a simultaneous effect will be produced by simply rotating the knob which will rotate both the disc 308 and the antennae 314.

A ladder 330 (FIGS. 3 and 9) is provided to give the figure toy access to the top surface 124 of the van for operation of the previously described accessories. The ladder 330 is generally formed in the shape of a letter *c* having a pair of tabs 332 at the bottom and a pair of vertical uprights 334 at the top end. The tabs 332 are insertable through apertures 336 in the side panel 62 for nesting within the channel defined at the bottom of the chassis 24. The vertical supports 334 fit within mating, generally rectangular apertures 338 in the seat frame structure 132. The ladder 330 includes a plurality of rungs 340 at the lower end and a plurality of handles 342 near the top. Again, the handles 342 are appropriately designed, like the handles 42, for use by the figure toy having a pair of mechanical hands or hooks instead of the normal anatomical hands.

Therefore, in accordance with the foregoing detailed description of the toy vehicle of the present invention, it can be seen that a unique vehicle of van 18 is provided. Particularly, all of the accessories and many of the features of the van as described above, are designed primarily for use by the figure toy described in the copending incorporated patent application. Particularly, each of the devices is operable by a figure toy having a pair of mechanical hands or hooks instead of the normal hands provided on previous toys or dolls. The previous detailed description, and reference to the copending application, have been given for clearness of understanding only and no unnecessary limitations should be understood therefrom since some modifications and changes will be obvious to those skilled in the art in view of the detailed disclosure herein.

We claim:

1. A toy vehicle, comprising:

a frame;

a plurality of rotatably mounted wheels on the frame for rollingly supporting the vehicle on a suitable surface;

a front windshield pivotally mounted at its top to the frame for movement between closed and open positions relative thereto;

biasing means for constantly urging the windshield in an upward direction about its pivotal mounting on the frame toward the open position; and a lower front portion pivotally mounted to the frame below the windshield, said lower front portion being movable between a first position in engagement with the windshield defining said closed position and a second position pivoted downwardly from said first position to define said open position for gaining access to an interior cab portion of the vehicle.

2. The toy vehicle of claim 1 including selectively operable connecting means between the windshield and the lower front portion for securing the lower portion and windshield in the closed position.

3. The toy vehicle of claim 1 wherein said lower portion has step means for facilitating movement into the cab portion, as by a figure toy, doll or the like.

4. A toy vehicle, comprising:

a frame;

a plurality of rotatably mounted wheels on the frame for rollingly supporting the vehicle on a suitable surface;

a rear tailgate pivotally mounted to the frame for movement between a generally vertical closed position and a generally vertical open position providing access to the interior of the vehicle; and detent means maintaining the tailgate in its closed position and latch means for maintaining the tailgate in its open position, said detent means being releasable upon outward pulling on the tailgate.

5. The toy vehicle of claim 4 wherein the tailgate is substantially devoid of outward protuberances which can be grasped and a security device for preventing opening of the tailgate, said security device comprising a magnetically attractive member pivotally mounted to the interior of the tailgate in alignment with an aperture therein, said magnetic member being adapted to emerge through said slot by magnetic forces to permit opening of the tailgate thereby.

6. The toy vehicle of claim 4 including a panel pivotally mounted to said tailgate and comprising a portion thereof whereby the panel is pivotal to a generally horizontal position providing a passageway through the tailgate.

7. A toy vehicle, comprising:

a frame;

a plurality of rotatably mounted wheels on the frame for rollingly supporting the vehicle on a suitable surface;

a rear tailgate pivotally mounted to the frame for movement between a generally vertical closed position and a generally vertical open position providing access to the interior of the vehicle;

selectively operable connecting means mounted on the tailgate; and a grasping device mounted on the interior of said tailgate by the connecting means and extending outwardly therefrom when the tailgate is in open position, said grasping device being operable from the opposite side of the tailgate.

8. The toy vehicle of claim 7 wherein said grasping device includes a yoke mounted to the tailgate by the connecting means, said grasping device being pivotally mounted to said yoke by an elongated arm for pivotal movement in at least a generally vertical direction.

9. The toy vehicle of claim 7 wherein said grasping device includes a pair of grasping members, at least one of said grasping members being pivotally mounted generally along said other grasping member and movable relative thereto so that an article may be grasped therebetween.

10. The toy vehicle of claim 9 wherein said movable grasping member includes biasing means to constantly urge said movable grasping member toward said other grasping member.

11. The toy vehicle of claim 10 wherein said movable grasping member includes a control line and is selectively movable against the force of said biasing means by the control line extending to the opposite side of said tailgate.

12. The toy vehicle of claim 11 wherein the control line is secured to a generally vertical movable slide mounted within a channel defined on said grasping device, said slide including an aperture therein to facilitate grasping and movement thereof.

13. The toy vehicle of claim 12 including a handle mounted on said channel having a pair of apertures therein adapted to be engaged by a pair of hooks.

14. The toy vehicle of claim 7 including a seat mounted on the top of the frame for supporting a figure toy in a position to operate said grasping device.

15. A toy vehicle, comprising:

a frame;

a plurality of rotatably mounted wheels on the frame for rollingly supporting the vehicle on a suitable surface;

a tethered grappling hook;

launching means for propelling said grappling hook from the vehicle;

means for mounting the launching means on the vehicle frame; and selectively releasable connecting means for securing the launcher to the launching means.

16. The toy vehicle of claim 15 wherein said mounting means includes a pair of handles, said handles including apertures therein suitable for engagement by a pair of hooks.

17. A toy vehicle, comprising:

a frame;

a plurality of rotatably mounted wheels on the frame for rollingly supporting the vehicle over a suitable supporting surface;

a top wall on the vehicle defining a top surface;

a raised rim generally about the periphery of said top surface; and a ladder adapted to be supported on the side of the frame to permit access to the top of the vehicle, said ladder being removably mounted by a portion thereof extending over said rim and including a plurality of handles on the sides thereof to facilitate climbing of the ladder by a figure toy.

18. The toy vehicle of claim 17 wherein each of said handles comprises an enlarged end cap to facilitate gripping thereof by a pair of hooks.

19. A toy vehicle, comprising:

a frame;

a plurality of rotatably mounted wheels on the frame for rollingly supporting the wheels on a suitable surface;

a radar antennae rotatably mounted on the top of the frame to simulate searching by rotation thereof;

a control panel on the interior of said frame and a simulated radar scope positioned on the control panel for viewing by a figure toy in the toy vehicle; and drive means connected to the radar antennae for rotation thereof, wherein said drive means includes a manually operable knob connected to a disc on the scope and including an arcuate ring about said disc in engagement with a vertical mounting shaft of the radar antennae for rotation thereof in response to rotation of said knob.

20. A toy vehicle, comprising:

a frame;

a plurality of rotatable wheels on the frame for rollingly supporting the vehicle over a suitable surface;

a door on the side of said vehicle providing access to the interior thereof; and a security device for maintaining said door in a closed position, said security device including a notch at the free end of said door and a hook implement of a size for insertion therethrough to open the door.

21. The toy vehicle of claim 20 including a rotatably mounted seat on the interior thereof for positioning a suitably adapted figure toy thereon.

* * * * *